US011014381B2

(12) United States Patent
Terrero et al.

(10) Patent No.: US 11,014,381 B2
(45) Date of Patent: May 25, 2021

(54) HONEYCOMB CORE PLATEN FOR MEDIA TRANSPORT

(71) Applicant: Xerox Corporation, Norwalk, CT (US)

(72) Inventors: Carlos M. Terrero, Ontario, NY (US); Brian J. Dunham, Webster, NY (US); James J. Spence, Honeoye Falls, NY (US)

(73) Assignee: Xerox Corporation, Norwalk, CT (US)

( * ) Notice: Subject to any disclaimer, the term of this patent is extended or adjusted under 35 U.S.C. 154(b) by 62 days.

(21) Appl. No.: 16/506,134

(22) Filed: Jul. 9, 2019

(65) Prior Publication Data

US 2021/0008901 A1 Jan. 14, 2021

(51) Int. Cl.
*B41J 11/00* (2006.01)
*B41J 11/06* (2006.01)

(52) U.S. Cl.
CPC ..... *B41J 11/0085* (2013.01); *B41J 11/007* (2013.01); *B41J 11/06* (2013.01)

(58) Field of Classification Search
CPC ..... B41J 11/0085; B41J 11/007; B41J 11/06
USPC ..... 347/101, 104
See application file for complete search history.

(56) References Cited

U.S. PATENT DOCUMENTS

| | | | | |
|---|---|---|---|---|
| 4,540,990 | A | 9/1985 | Crean | |
| 6,672,720 | B2 * | 1/2004 | Smith | B41J 11/007 271/197 |
| 8,388,246 | B2 * | 3/2013 | Spence | B41J 11/007 400/611 |
| 8,408,539 | B2 | 4/2013 | Moore | |
| 8,944,586 | B2 * | 2/2015 | Chung | B41J 11/0085 347/104 |
| 9,403,380 | B2 | 8/2016 | Terrero et al. | |
| 9,815,303 | B1 * | 11/2017 | Herrmann | B41J 13/08 |
| 10,160,323 | B2 | 12/2018 | Griffin et al. | |
| 2007/0070099 | A1 | 3/2007 | Beer et al. | |
| 2017/0239959 | A1 | 8/2017 | Sanchis Estruch et al. | |

FOREIGN PATENT DOCUMENTS

EP 1726446 A1 11/2006

* cited by examiner

*Primary Examiner* — An H Do
(74) *Attorney, Agent, or Firm* — Fay Sharpe, LLP

(57) ABSTRACT

Disclosed is a media transport system utilizing a honeycomb core platen for transporting and maintaining the flatness of a sheet of media in an associated printing system. According to one exemplary embodiment, the honeycomb platen includes a plurality of laminated layers that include features configured to communicate vacuum throughout the entire thickness of the platen.

28 Claims, 7 Drawing Sheets

HONEYCOMB CORE PLATEN FOR MEDIA TRANSPORT

BACKGROUND

The present disclosure is directed to a printing press substrate transport system to transport and secure substrates for forming images on an imaging surface. More particularly, the present disclosure is directed to lightweight vacuum platens with a uniform flatness that transport, secure, and maintain a large substrate flat under a print-head.

Conventional ink-jet printing systems use various methods to cause ink droplets to be directed toward recording media. Well known ink-jet printing devices include thermal, piezoelectric, and acoustic ink jet print head technologies. All of these ink-jet technologies produce roughly spherical ink droplets having a 15-100 μm diameter directed toward recording media at approximately 4 meters per second. Located within these print heads are ejecting transducers or actuators, which produce the ink droplets. These transducers are typically controlled by a printer controller, or conventional minicomputer, such as a microprocessor.

A typical printer controller will activate a plurality of transducers or actuators in relation to movement of recording media relative to an associated plurality of print heads. By controlling activation of transducers or actuators and recording media movement, a printer controller should theoretically cause produced ink droplets to impact recording media in a predetermined way, for the purpose of forming a desired or preselected image on the recording media. An ideal droplet-on-demand type print head will produce ink droplets precisely directed toward recording media, generally in a direction perpendicular thereto.

Larger recording media, such as B series paper sizes, B1 (30 inches by 40 inches) and B2 (23.55 inches by 30 inches) require print-bars with multiple print-heads to form a larger marking area. The larger media sheets are usually transported under the print-heads by a conveyor belt system. The conveyor belt system moves the media sheet and maintains the media flat under a print-head-gap of less than 1 mm. The transport system may be a vacuum system including a perforated belt between that is driven over a vacuum platen. A vacuum is pulled through the perforated belt and platen by a vacuum system. The platen controls the flatness of the belt and subsequently, the media in a printing zone. It is very challenging to maintain the flatness across the large print area of larger media. The platen must have a low coefficient of friction to reduce drag from the belt of the conveyor system. The durability of current polymer platen coatings does not meet the life-expectancy of typical printing systems. That is, the coating applied to the platen to reduce belt drag may wear over time—increasing the drag and decreasing drive capacity. The replacement of a worn-out platen is costly and undesirable.

Furthermore, due to the small gap between the print head and media substrate, the flatness of the conveyor transport is critical. Variation in the gap will lead to image quality disturbances due to the variation in the ink drip flight time, dispersion, and trajectory. A reduced gap may also lead to media/substrate sheets striking the print bar resulting in print-head damage and jams.

Current methods to control the flatness of the platen include precise machining of a metal (aluminum and/or steel) plate. The plate thickness (stiffness) required to maintain the flatness in the application results in a heavy part. The machining cost to achieve the required flatness of less than 200 microns is also high. Some manufacturers choose to split the platen into smaller and more manageable plates. However, the interface where two or more plates meet must be appropriately managed so that the overlying media substrate is not disturbed. This means more machining to an otherwise already heavily machined part, increasing costs.

U.S. Patent Publication No. 20170239959 titled "Print Zone Assembly, Print Patent Device, and Large Format Printer" and European Patent No. EP 1726446 titled "Printing Table for a Flat-Bed Printing Machine," each incorporated by reference herein, are directed to maintaining the flatness of a platen by adjusting strategic points to warp the platen into place. This adjustment attempts to compensate for the lack of flatness in the initial state. This requires precise measurement and a timely/costly setup procedure. Furthermore, none of the solutions in the prior art solve issues related to having a heavy part which is subject to wear and cumbersome to replace.

U.S. Pat. No. 4,540,990 titled "Ink Jet Printed with Droplet Throw Distance Correction" and U.S. Patent Publication No. 2007/070099 titled "Methods and Apparatus for Inkjet Printing on Non-planar Substrates" describe compensation for a lack of platen flatness by adjusting the ink drop trajectory for varying print gaps. These solutions require precise measurements and control.

This disclosure provides a printing transport system which solves or avoids most if not all of the problems experienced in the prior art, many of those problems having been briefly discussed above, but also to design an ink-jet printing system which solves or avoids most problems arising from present advances in ink-jet printing technology.

INCORPORATION BY REFERENCE

U.S. Pat. No. 9,403,380, issued Aug. 2, 2016, by Terrero et al. and entitled "Media Height Detection System for a Printing Apparatus";

U.S. Pat. No. 10,160,323, issued Dec. 25, 2018, by Griffin et al. and entitled "Ink-jet Printing Systems";

U.S. Pat. No. 8,408,539, issued Apr. 2, 2013, by Moore and entitled "Sheet Transport and Hold Down Apparatus";

U.S. Pat. No. 4,540,990, issued Sep. 10, 1985, by Crean and entitled "Ink Jet Printed with Droplet Throw Distance Correction";

U.S. Patent Publication No. 2007/0070099, published Mar. 29, 2007, by Beer et al. and entitled "Methods and Apparatus for Inkjet Printing on Non-planar Substrates";

U.S. Patent Publication No. 2017/0239959, published Aug. 24, 2017, by Sanchis Estruch et al. and entitled "Print Zone Assembly, Print Patent Device, and Large Format Printer"; and European Patent No. EP 1726446, publication date Nov. 29, 2006, by Thieme GmbH & Co. KG and entitled "Printing Table for a Flat-Bed Printing Machine", are incorporated herein by reference in their entirety.

BRIEF DESCRIPTION

Various details of the present disclosure are hereinafter summarized to provide a basic understanding. This summary is not an extensive overview of the disclosure and is neither intended to identify certain elements of the disclosure, nor to delineate scope thereof. Rather, the primary purpose of this summary is to present some concepts of the disclosure in a simplified form prior to the more detailed description that is presented hereinafter.

In one embodiment of this disclosure, described is platen for use in a transport system operatively associated with a printing system including a honeycomb core. The honeycomb core is composed of an array of hollow columnar cells formed between vertical walls. The platen also includes at least one face layer as an outermost layer of the platen, the at least one face layer operatively connected to the honeycomb core and including a plurality of slots in vacuum communication with the array of hollow columnar cells In another embodiment of this disclosure, described is a media transport system operatively associated with a printing system. The media transport system includes a perforated belt including a plurality of belt apertures. The belt is mounted on a plurality of rollers. The media transport system also includes a platen a surface disposed below the perforated belt including a honeycomb core having a thickness and composed of an array of hollow columnar cells formed between vertical walls and a vacuum plenum being operatively connected to a vacuum source configured to apply a negative pressure to a media through the array of hollow columnar cells and plurality of belt apertures for securing the media to the perforated belt.

In another embodiment of this disclosure, described is a process for making a platen for use in a media transport system. The process includes providing a honeycomb core composed of an array of hollow columnar cells formed between vertical walls and then laminating via an epoxy at least one layer to a top surface of the honeycomb core. The laminated structure, laminated layer and honeycomb core are pressed together to generate a substantially flat surface.

BRIEF DESCRIPTION OF THE DRAWINGS

The following is a brief description of the drawings which are presented for the purposes of illustrating the exemplary embodiments disclosed herein and not for the purposes of limiting the same.

DETAILED DESCRIPTION

Figure 1:
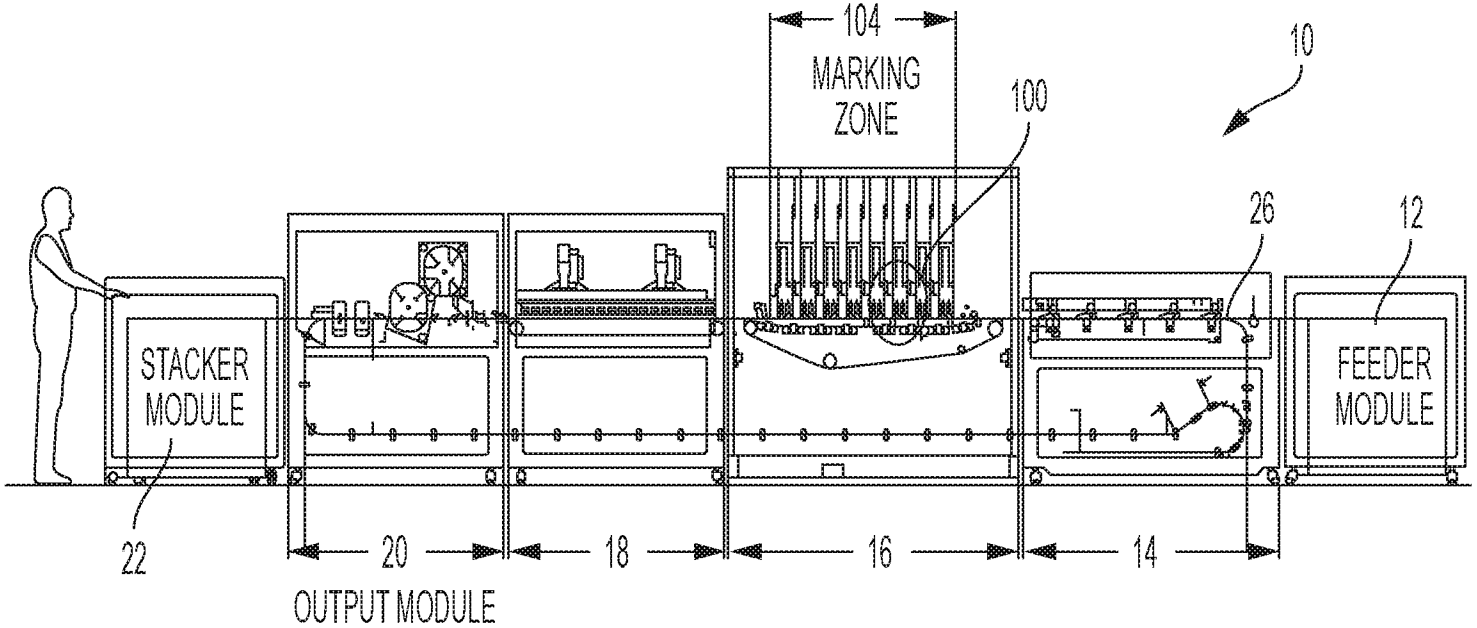
FIG. 1 illustrates a side view of an exemplary printing system incorporating a marking module and transport system.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/components/steps and permit the presence of other ingredients/components/steps. However, such description should be construed as also describing compositions, articles, or processes as "consisting of" and "consisting essentially of" the enumerated ingredients/components/steps, which allows the presence of only the named ingredients/components/steps, along with any impurities that might result therefrom, and excludes other ingredients/components/steps.

As used herein, a "printer," "printing assembly" or "printing system" refers to one or more devices used to generate "printouts" or a print outputting function, which refers to the reproduction of information on "substrate media" or "media substrate" or "media sheet" for any purpose. A "printer," "printing assembly" or "printing system" as used herein encompasses any apparatus, such as a digital copier, bookmaking machine, facsimile machine, multi-function machine, etc. which performs a print outputting function.

The term "media" as used throughout this disclosure is understood by one of ordinary skill in the present technology as referring, e.g., to a pre-cut and generally flat sheet of paper, film, parchment, transparency, plastic, fabric, photo-finished substrate, paper-based flat substrate, or other substrate, whether coated or non-coated, on which information including text, images, or both can be reproduced. Generally, at least a portion of the information noted may be in digital form, since pre-imaged substrates may include images that are not digital in origin. The information can be reproduced as repeating patterns on media in the form of a web.

FIG. 1 illustrates a side view of an exemplary printing system 10 incorporating a marking module 16 and transport system 100. The schematic illustration depicts a digital printing press/system 10 for printing large media, for example, B1 and B2 sized sheets of paper. The exemplary printing press 10 includes a feeder module 12, a registration module 14, a marking module 16, a dryer module 18, an output module 20, and stacker module 22. It is to be understood that the modules 12-22 are non-limiting and that a printing press system 10 may include other modules for media processing or some modules described herein may be absent from a system altogether. Media is processed by the printing press 10 along a media path 26 in a process direction. The process direction in FIG. 1 is from right to left and shown as the direction from the feeder module 12 to the stacker module 22. The printing press 10 starts processing at the feeder module 12. The feeder module 12 stores sheets of media and starts a printing process by supplying a sheet of media to the media path 26. The media path 26 may include a plurality of rollers or similar devices configured to advance the media sheet in the process direction. The sheet/substrate of media is transported via the media path 26 in the process direction from the feeder module 12 to the registration module 14 wherein the media is aligned for entry to the marking module 16. Registration may be achieved by sets of nip rolls or by other means known in the art. The nip rolls are released when a lead edge of the media substrate is acquired by the transportation system 100 of marking module 16.

The marking module 16 utilizes a media transport system, described in greater detail below, that includes a transport belt that acquires the media substrate, places the media substrate in a printing zone, maintains the flatness of the media substrate during printing, and transports the media substrate to the next module along the process direction. For example, after the printing process by the marking module 16 is complete, the printed media substrate is transported and dried/cured in the dryer module 18 in the process direction. After the printed media substrate is dried/cured, the died/cured media may be output from the printing system 10 and in some embodiments, stacked by a staking module 22.

Figure 2:
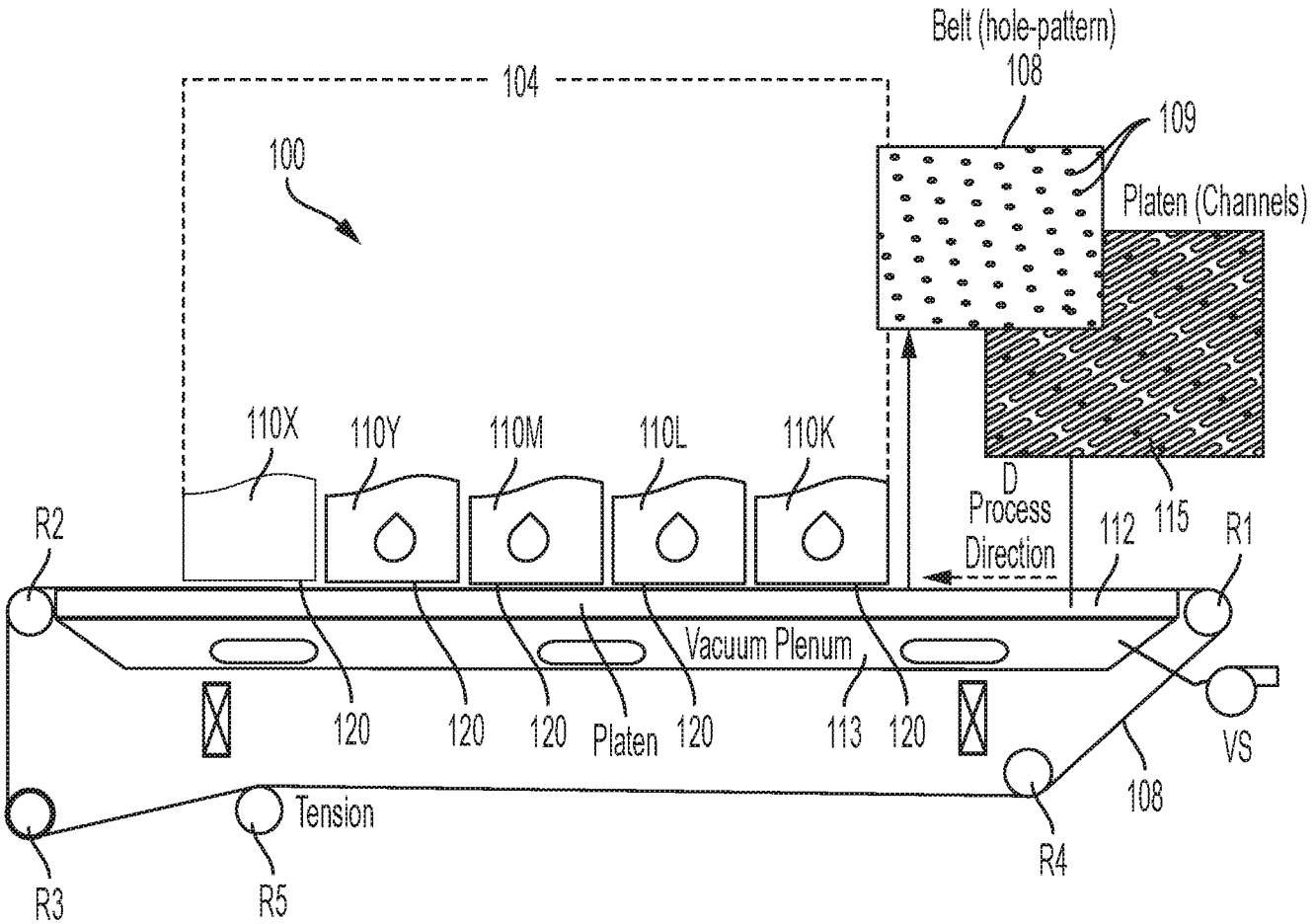
FIG. 2 illustrates a side view of an exemplary media transport system associated with a printing system.

FIG. 2 depicts a basic media transport system 100 of a marker module 16 for transporting media to and through a print zone 104. This system 100 is presented to illustrate the basic operations and components of a media transport system 100 associated with a printing system, such as printing system 10. The exemplary media transport system 100 includes a smooth-surfaced belt 108, seamed or seamless, mounted on a plurality of rollers, such as rollers R1, R2, R3 and R4. At least one roller of the plurality of rollers (R1, R2, R3 and R4) is operably connected to a motor (not shown) to drive the belt 108. That is, the operably connected motor causes the belt to advance such that a media substrate that is present on the belt 108 is "transported," i.e., moved in a process direction D. While FIG. 2 illustrates a transport system associated with a marking module 16 and transportation through a print zone 104, it is to be appreciated that such a transport system 100 may be used in other modules to transport the media substrate in a desired direction.

The print zone 104 illustrated in FIG. 2 is shown as an area generally under the ink jet print heads 110, represented by exemplary black ink print head 110K, exemplary cyan ink print head 110C, exemplary magenta ink print head 110M, and exemplary yellow ink print head 110Y. The number and color of the print heads 110 are non-limiting. That is, additional print heads 110X may be included in the marking module 16 and defining the print zone 104 as desired. Each of the above-mentioned ink-jet print heads 110K, 110C, 110M, 110Y, 110X includes its own face plate 120 which is closely-spaced to the transport belt 108 for precisely jetting its ink onto a media substrate that is carried by the transport belt 108 through the print zone 104.

The transport belt 108 is illustrated in the exemplary transport system 100 as an endless loop. The endless loop shape of the transport belt 108 is dimensioned to fit snuggly on the plurality of rollers, e.g., R1, R2, R3 and R4. That is, the transport belt 108 is a flat loop having an interior surface that is configured to contact an outer surface of the plurality of rollers R1, R2, R3 and R4 and an exterior surface that is configured to contact and transport a media substrate. In some embodiments, each of rollers R1, R2, R3 and R4 has a rubber coating for electrically isolating each of rollers R1, R2, R3 and R4 from an inner surface of media-transport belt 108. The transport system 100 may also include a tension roller R5 for adjusting a desired tension of the transport belt 108.

The movement of the transport belt 108 is facilitated by a motor operably connected to at least one roller of the plurality or rollers. A media substrate is captured by the transport belt 108 along the process direction D, for example, from a registration module 14 or feeder module 12. The transport belt 108 movement in the process direction further enables a media substrate placed on the transport belt 108 to advance toward the print zone 104 of a marking module 14. In the print zone 104, tiny droplets of ink are sprayed onto the transported media in a controlled manner for the purpose of printing a desired image or text onto media passing by. In conventional direct-to-media ink-jet marking engines, an ink jet print head is mounted such that its face 120 (where ink nozzles are located) is spaced, typically 1 mm or less, from the media surface. Since media such as paper may possess a curl property that lifts at least a portion of the media more than 1 mm above the surface of the transport belt 108, the curl property of the media poses a problem whenever sheets of paper contact a print head when passing through print zone 104.

The exemplary transport system 100 may also include a mechanism for securing a sheet of media in place on the transport belt 108. One such mechanism is the utilization of a vacuum system, e.g., a vacuum plenum 113 with a platen 112 as its upper surface. U.S. Pat. No. 8,408,539 incorporated by reference in its entirety herein discloses a media sheet transport utilizing a vacuum plenum in combination with a transport belt. Generally, the vacuum plenum 133 illustrated in FIG. 2, is a chamber or place in which a negative pressure is applied. As used herein, "negative pressure" refers to an air pressure that is below atmospheric pressure. A vacuum source VS is operably connected to the vacuum plenum 113 so that the vacuum plenum 113 applies a negative pressure through platen 112 to the media for holding the media flat to the transport belt 108.

The platen 112 presents a top flat surface against which the transport belt 108 and carried media is held. The transport belt 108 is caused to slide across the top flat surface of platen 112 by a motor (not shown) powering at least one of the rollers R1, R2, R3 and R4, to cause sheets of media (not shown) carried by the transport belt 108 to move. In operation, the platen 112 presents a fixed surface and the transport belt 108 is caused to slide thereacross. A platen 112 may be included on the top of the vacuum plenum 133 over which the transport belt 108 translates. The platen may have a plurality of slots 115 configured to communicate vacuum from the plenum 113 to the top most surface. The transport belt 108 may include a plurality of apertures 109 formed therein such that the vacuum may flow down through the transport belt 108 and platen 112. In other words, the slots 115 and belt apertures 109 enable the vacuum plenum 113 and platen 112 to subject the media carried by the transport belt 108 to vacuum. Accordingly, a sheet of media transported over the platen 112 will be held down onto the belt 108 by vacuum force.

As briefly described above, the transport belt 108 may be perforated, including a plurality of apertures 109 distributed substantially across its width for enabling the vacuum plenum 113, located beneath the transport belt 108, to cause media to be drawn to the transport belt 108. In some embodiments, a square pattern for the apertures 109 is used, where an individual aperture 109 is generally circular. In some embodiments, the circular apertures have a diameter of about 2 mm. The size, pattern, and grouping of the apertures 109 are non-limiting and may be varied to achieve a particular vacuum state as different media substrates may require specific vacuum conditions/flow.

This disclosure further provides, in part, a platen design that utilizes a lightweight, high strength to weight ratio, honeycomb core 202. The honeycomb structure provides a core having a low density yet relatively high compression and sheer properties. That is, over 50% of the volume of the honeycomb core 202 is occupied by air. In some embodiments, about 50% to about 97% of the volume of the honeycomb core 202 is occupied by air. With reference to the exemplary embodiment honeycomb platen 212A of FIG. 3A, the geometry of the honeycomb structure features an array of hollow cells 203 formed between vertical walls 204. The vertical walls 204 may be formed of a foil substrate that is processed to create an array of hollow cells. The vertical walls 204 are generally thin, having a thickness from about 0.025 mm to about 4.0 mm. The cells 203 are generally columnar and generally hexagonal in shape, although other similar shapes may also be used, including tubular, triangular, and square shapes. The honeycomb core 202 is characterized by having a high strength to weight ratio and is configured to provide a stable and robust base. In some embodiments, the honeycomb core 202 is composed of a metal material. In more particular embodiments, the metal material of the honeycomb core 202 is aluminum. In other embodiments, the honeycomb core 202 is made of a non-metal material, for example and without limitation, fiberglass, and composite materials. The honeycomb structure of the core allows for 37 times increase of stiffness at approximately the same weight as a homogenous material such as a solid metal platen. The honeycomb core 202 allows for the platen to have a large area with the required flatness of a large media print system. In some embodiments, the flatness is less than about 300 micrometers. In further embodiments, the flatness is less than about 200 micrometers. In yet still further embodiments, the flatness is less than 150 micrometers.

The honeycomb core 202 may range in thickness (corresponding to a height H of the columnar cells 203) from about ⅛ inch (3.175 mm) to about 1.5 inches (38.1 mm), including ¼ inch (6.35 mm), ⅜ inch (9.525 mm), ½ inch (12.7 mm), ⅝ inch (15.875 mm), ¾ inch (19.05), 1 inch (25.4 mm), 1 1/18 inches (28.575 mm), 1⅝ inches (31.75 mm), 1⅜ inches (34.925 mm).

The hollow honeycomb cells 203 of the honeycomb core 202 allow for the passage of air and/or vacuum that may be communicated by an adjacent vacuum platen, such as vacuum plenum 113 described above. In other words, the honeycomb core 202 is operatively connected to a vacuum source. In some embodiments, a surface of the honeycomb core 202 is in direct contact with the vacuum plenum 113. In other embodiments, a surface of a layer laminated to the honeycomb core 202 (an outermost surface of the platen) is in direct contact with a vacuum plenum 113 such that negative pressure of the vacuum plenum is communicated trough the hollow cells 203 of the honeycomb core 202.

This disclosure also provides, in part, a multi-layer platen design that is bonded together via a lamination process. The multi-layer platen is lightweight in comparison to prior art platens which are composed primarily of solid machined metal. In accordance with the present disclosure and with reference to FIG. 3A, a multi-layer platen 212A is provided. In the exemplary embodiment illustrated in FIG. 3A, the honeycomb platen 212A includes a face layer 210A. The face layer 210A has a top surface 209 that is configured to contact an associated transport belt, such as transport belt 108 described above and associated with a transport system 100. The top surface 209 of the face layer 210A is a surface with a low coefficient of friction such that the transport belt may easily slide over the face layer 210A with minimal to no degradation of the transport belt or platen surface 209.

The face layer 210A includes a plurality of slots 211 through the layer that are configured to communicate air and/or vacuum from the cells 203 of honeycomb core 202. That is, the slots 211 may align with the hollow cells 203 of the core allowing a vacuum platen, such as vacuum plenum 113 placed in vacuum communication with the honeycomb core 202, to draw vacuum through the plurality of slots 211. In some embodiments, the face layer 210A is composed of a metal sheet that is manufactured with the desired features, e.g., slots 211. In some embodiments, the slots 211, are further configured to communicate vacuum through apertures in an associated perforated belt, such as apertures 109 of belt 108 described above. The face layer 210 is generally composed of a thin sheet of material having a thickness from about 1/16 inch (1.5875 mm) to about ¼ inch (6.35 mm).

Figure 3A:
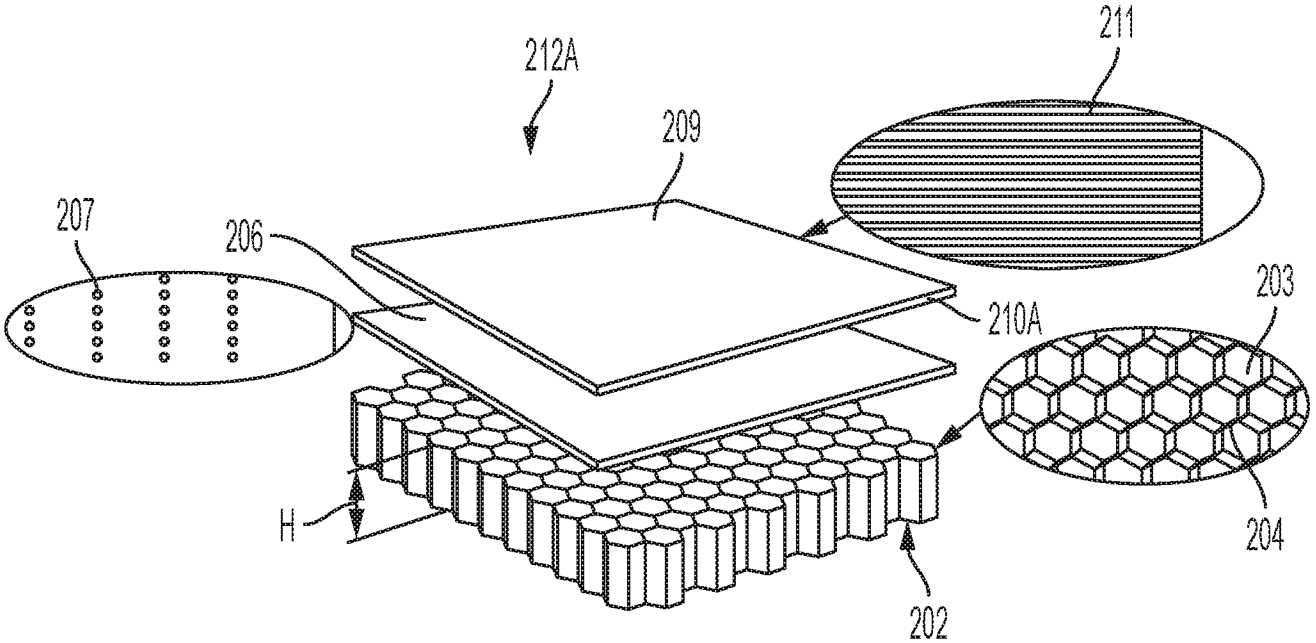
FIGS. 3A and 3B illustrate exploded views of platens with honeycomb cores in accordance with an exemplary embodiment of the present disclosure.

In some embodiments and with continued reference to FIG. 3A, a platen 212A may include an inner layer 206A disposed between the face layer 210A and honeycomb core 202. The inner layer 206A includes a plurality of holes 207 that are configured to communicate vacuum between the columnar cells 203 of the honeycomb core 202 and slots 211 of the face layer 210A. The holes 207 may be stamped or laser cut through the inner layer 206A. The inner layer 206A is generally composed of a thin sheet of material having a thickness from about 1/16 inch (1.5875 mm) to about ¼ inch (6.35 mm). The inner layer 206A may be made of a plastic (polymeric) material, metal material, or ceramic material. The inner layer 206A is configured to control airflow provided to the top layer. In some embodiments, the inner layer 206A aids in reducing turbulence in the air flow/vacuum to the face layer 210A.

As illustrated in the exemplary embodiment of FIG. 3A, the plurality of holes 207 in the inner layer 206 are shaped as circles. The circle diameter of the holes 207 may be from about 1 mm to about 10 mm, including 2, 3, 4, 5, 6, 7, 8, and 9 mm, and any length between. It is to be appreciated that the holes of the inner layer may be variously shaped, and the circle shape of the holes 207 illustrated in FIG. 3A is non-limiting. Furthermore, the size and shape of the holes 207 relate to the airflow through the platen. 212A. Thus, the size and shape of the holes 207 may be optimized such that a particular air flow is achieved, and a desired vacuum force is applied to a sheet of media.

Generally, each hole 207 is configured to communicate air/vacuum with at least one columnar cell 203 of the honeycomb core 202. Furthermore, at least one slot 211 is configured to communicate air/vacuum with at least one hole 207, resulting in air/vacuum communication with at least one columnar cell 203. In some embodiments, a slot 211 extends along a length of the face layer such that spans the length of two or more holes 207 present in an underlying inner layer 206.

In some embodiments, a coating may be applied to the top surface 209 of the face layer 210A. The coating may facilitate sliding movement between the face layer 210A and an associated belt (such as transport belt 108). That is, the coating may be a low friction coating such as a Teflon® coating. In some embodiments, the coating provides a surface with a coefficient of friction of about 0.3. In preferred embodiments, the coating provides a surface with a coefficient less than about 0.3.

Figure 3B:
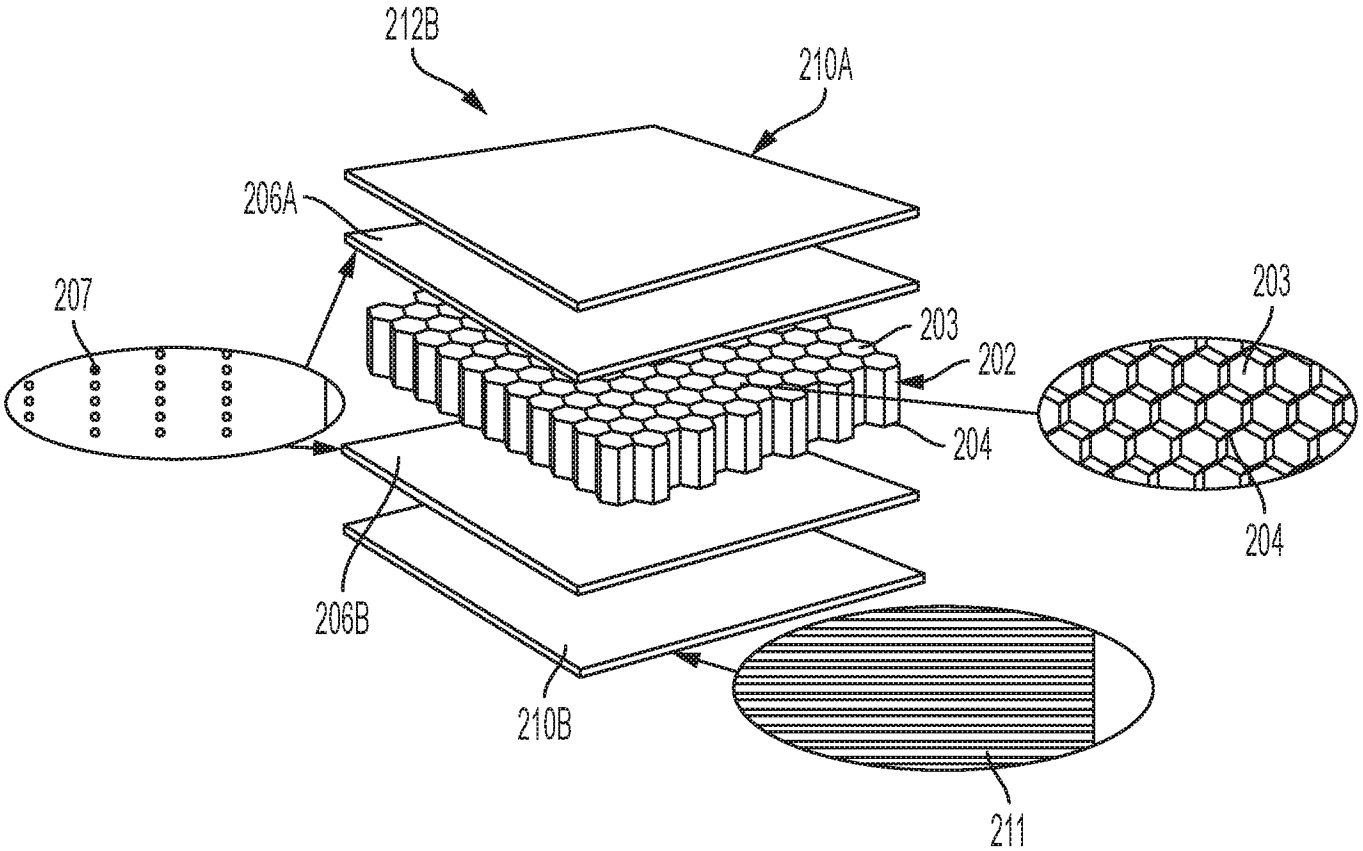

This disclosure also provides, in part, a double-sided (reversable) multi-layer platen design that is bonded together via a lamination process. The double sided multi-layer platen is lightweight in comparison to prior art platens which are composed primarily of solid machined metal. In accordance with the present disclosure and with reference to FIG. 3B, a reversable multi-layer platen 212B is provided. The center layer includes a light honeycomb core 202 as described above with respect to the accompanying description of FIG. 3A. The honeycomb core 202 is characterized by having a high strength to weight ratio and is configured to provide a stable and robust base for a layer stack to be laminated on each side.

In some embodiments, the platen 212B further includes a face layer 210A and 210B on each side of the honeycomb core 202. The face layers 210A-B are the outermost layers of the platen 212B. The face layers 210A-B include a plurality of slots 211 that are configured to communicate vacuum from the honeycomb core 202. That is, a vacuum platen, such as vacuum plenum 113, may be placed in contact/vacuum communication with the surface of one face layer 210A or 210B, and vacuum is drawn through each layer through the entire thickness of the platen 212B. In some embodiments, the face layers 210A-B are composed of metal sheets that are manufactured with the desired feature, e.g., slots 211. In some embodiments, the slots 211, are further configured to communicate vacuum through apertures in an associated perforated belt, such as apertures 109 of belt 108.

In some embodiments, the face layer 210A is identical to the face layer 210B. In this way, if the face layer 210A is degraded over time by contact with an associated transport belt, the platen 212B may be flipped over wherein face layer 210B becomes the top surface of the transport system which is now placed in contact with the associated transport belt. This reversibility imparts an extended life upon the platen product, having two operable sides that can be switched once one side fails or the performance degrades.

In other embodiments, face layers 210A and 210B are not identical. In some embodiments, the pattern, shape, and/or size of the features, e.g., slots, may be different. The pattern, shape, and size of the features generally affect the flow of vacuum about the surface. In this way, one side of the platen 212B may be optimized for a particular media substrate and the other side optimized for another. For example and without limitation, one side, such as the side with face layer 210A, may be optimized to have a vacuum flow for transporting and maintaining the flatness of paper media and the other side, such as the side with face layer 210B, may be optimized to have a vacuum flow for transporting and maintaining the flatness of cardboard media. It is to be appreciated that while paper and cardboard media are expressly described herein, other media materials known in the art may be used and the flow of vacuum optimized therefor.

In some embodiments, the platen 212B further includes a pair of inner layers 206A and 206B. The inner layers 206A-B are sandwiched between the honeycomb core 202 and each face layer 210A-B. The inner layers 206A-B include a plurality of holes 207 that are configured to communicate vacuum between the honeycomb core 202 and face layers 210A-B. The holes 207 may be stamped or laser cut into the inner layers 206.

In some embodiments, inner layer 206A is identical to inner layer 206B. In other embodiments, inner layers 206A and 206B are not identical. In some embodiments, the pattern, shape, and/or size of the features, e.g., holes 207, may be different. The pattern, shape, and size of the hole features generally affect the flow of vacuum about the surface in combination with the pattern, shape, and size of the slots 211 of the adjacent face layer (either 210A or 210B).

Generally, each hole 207 is configured to communicate air/vacuum with at least one columnar cell 203 of the honeycomb core 202. Furthermore, at least one slot 211 is configured to communicate air/vacuum with at least one hole 207, resulting in air/vacuum communication with at least one columnar cell 203. In some embodiments, a slot 211 extends along a length of the face layer such that spans the length of two or more holes 207 present in an underlying inner layer 206. In some embodiments, the face layers 210A and 210B are each coated with an identical coating. The coating may be a low friction coating such as a Teflon® coating available from DuPont. In some embodiments, the coating of the face layer 210A is different from the coating of face layer 210B. That is, the coating of face layer 210A may have a coefficient of friction that is different from the coefficient of friction of the coating of layer 210B.

Figure 4:
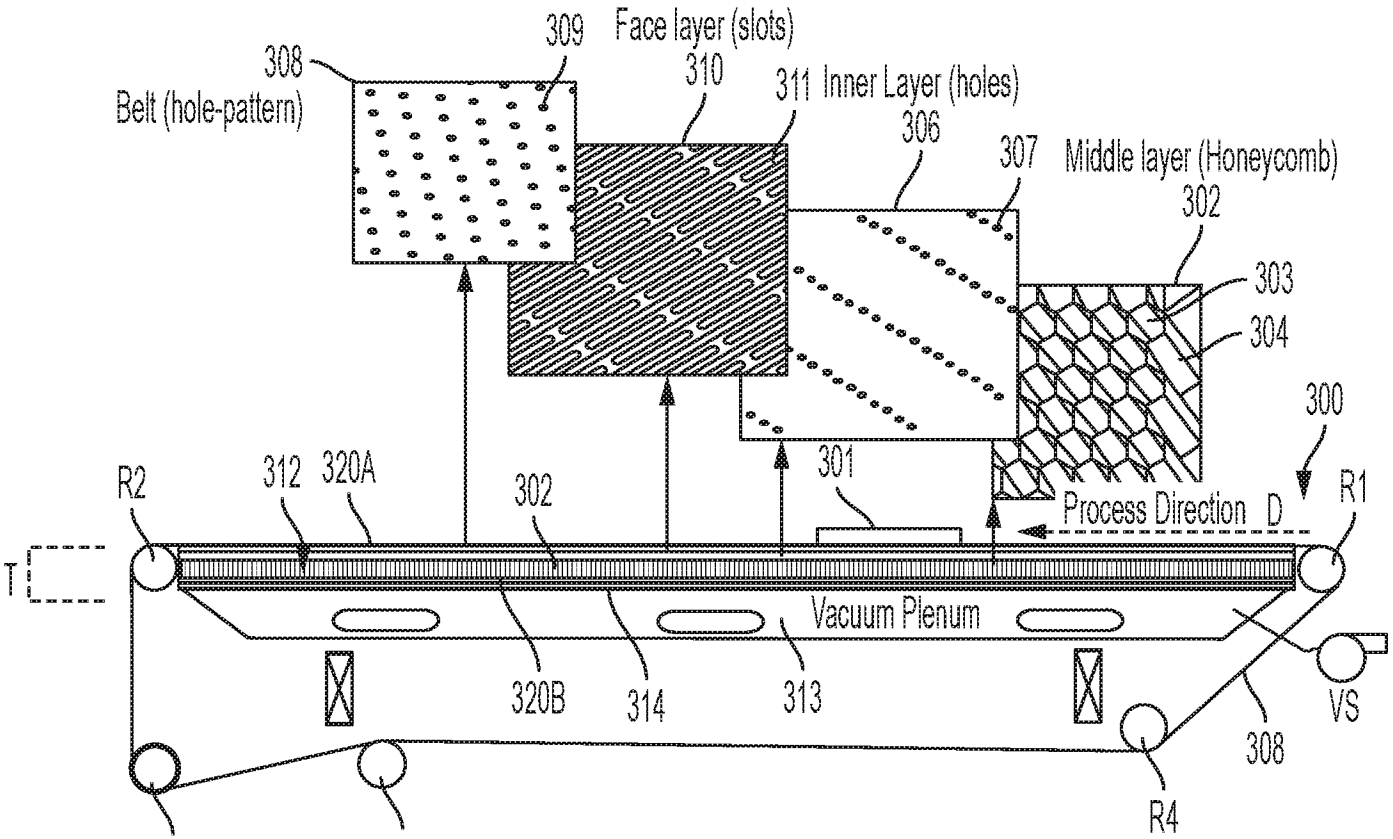
FIG. 4 illustrates a transport system utilizing a patent with a honeycomb core in accordance with an exemplary embodiment of the present disclosure.

In accordance with another aspect of the present disclosure and with reference to FIG. 4, a transport system 300 with a honeycomb core platen is provided. The transport system 300 includes a perforated belt 308, seamed or seamless, mounted on a plurality of rollers, such as rollers R1, R2, R3 and R4. At least one roller of the plurality of rollers is operably connected to a motor (not shown) to drive the belt 308, for causing a sheet of media 301 that is on the belt 308 to be "transported," i.e., moved in a process direction D.

The perforated belt 308, is generally formed as an endless loop and is configured to fit snuggly on the plurality of rollers, e.g., R1, R2, R3 and R4. In some embodiments, each of rollers R1, R2, R3 and R4 has a rubber coating to electrically isolate each of rollers R1, R2, R3 and R4 from an inner surface of media-transport belt 308. The transport system may also include a tension roller R5 for adjusting a desired tension of the perforated belt 308.

The transport system 300 includes vacuum plenum 313 with a honeycomb core platen 312 as its upper surface. The vacuum plenum 313 is a chamber in which a negative pressure is applied via a connection to a vacuum source VS (e.g., a vacuum pump). The vacuum plenum 313 has a plenum surface 314 that is operably connected to an opposing surface (illustrated in FIG. 4 as surface 320B) of the honeycomb core platen 312. The vacuum plenum 313 is configured to apply a negative pressure through the honeycomb core platen 312 and to the media 301 for holding the media 301 to the belt 308.

The honeycomb core platen 312 presents a flat surface 320A against which the media transport perforated belt 308 is held. Perforated transport belt 308 is caused to slide across the flat surface of platen 312 by a motor (not shown) powering at least one of the rollers R1, R2, R3 and R4, to cause sheets of media (not shown) carried by the media-transport belt 308 to move in the process direction D. In some embodiments, the media transport system 300 is incorporated into a marking module of a printing system and the transport system is configured to transport a media substrate through a print zone. In operation, the platen 312 presents a fixed surface, and transport belt 308 is caused to slide thereacross.

The honeycomb core platen 312 of the exemplary transport system 300 is in air/vacuum communication with vacuum plenum 313. The honeycomb core platen 312 includes a honeycomb core 302 similarly configured to the honeycomb core 202 of FIGS. 3A-3B described above. The honeycomb core 302 includes a plurality of hollow cells 303 formed between thin vertical walls 304. The cells 303 are generally columnar and generally hexagonal in shape, although as described above, the shape of the cells is non-limiting. The hollow cells 303 are configured to communicated vacuum drawn from the vacuum plenum 313 through a plurality of apertures 309 extending substantially across an associated belt 308 for enabling the vacuum plenum 313 located beneath belt 308 to cause media to be drawn to belt 308 to hold and secure a media substrate thereon.

The hollow honeycomb cells 303 of the honeycomb core 302 allow for the passage of air and/or vacuum that may be communicated by an adjacent vacuum plenum 313. In other words, the honeycomb core 302 is operatively connected to a vacuum source. In the exemplary embodiment of FIG. 4, a surface 320B of a face layer laminated to the honeycomb core 302 is in direct contact with the vacuum plenum 313 such that negative pressure of the vacuum plenum 313 is communicated through the hollow cells 303 of the honeycomb core 302 and to a sheet of media 301.

The honeycomb platen 312 may be variously embodied as platens 212A and 212B including a plurality of stacked layers. That is, the platen 312 may have at least one face layer 310 including a plurality of slots 311 and have at least one inner layer 306 including a plurality of holes 307. The slots 311 and holes 307 may be aligned with the honeycomb cells 303 and each other in order to communicate vacuum throughout a thickness T of the platen 312. In some embodiments, the honeycomb platen 312 is a reversible platen to which either surface 320A or 320B may be a top surface adjacent the belt 308 or in direct contact with the vacuum plenum 313.

In accordance with another aspect of the present disclosure, a process for creating a platen for use in a large media transport system is provided. The platen includes a honeycomb core such as core 202, 302, at least one inner layer such as inner layer 206A or 206B, and at least one face layer such as face layer 210A or 210B. Each layer is adhered to adjacent layers via an adhesive. In some embodiments, the adhesive is an epoxy. In other embodiments, the adhesive is a UV curable adhesive. In other embodiments, the adhesive is a thermal cure adhesive. That is, the at least one inner layer 206A, 206B is laminated to the honeycomb core 202 via an epoxy, and the at least one face layers 210A, 210B is laminated to an outer surface of the at least one inner layers. It is to be appreciated that the order of laminations in not limiting, for example, the inner and face layers (206 and 210 respectively) may be laminated together before the created stack is laminated to the honeycomb core 202.

The laminated stack of layers (face layer 210, inner layer 206, core 202, inner layer 206, face layer 210) is placed within a press. The press is configured to apply pressure to the layer stack and the flatness of the resulting platen 214 is controlled by the parallelism of the opposing plates of the press. In some embodiments, the press also provides heat to the laminated layers stack.

In some embodiments, a low friction coating, such as a Teflon® coating is applied to the outer surfaces of the face layers 210. The low friction coating may be applied to the face layers 210 before or after the press process.

Figure 5:
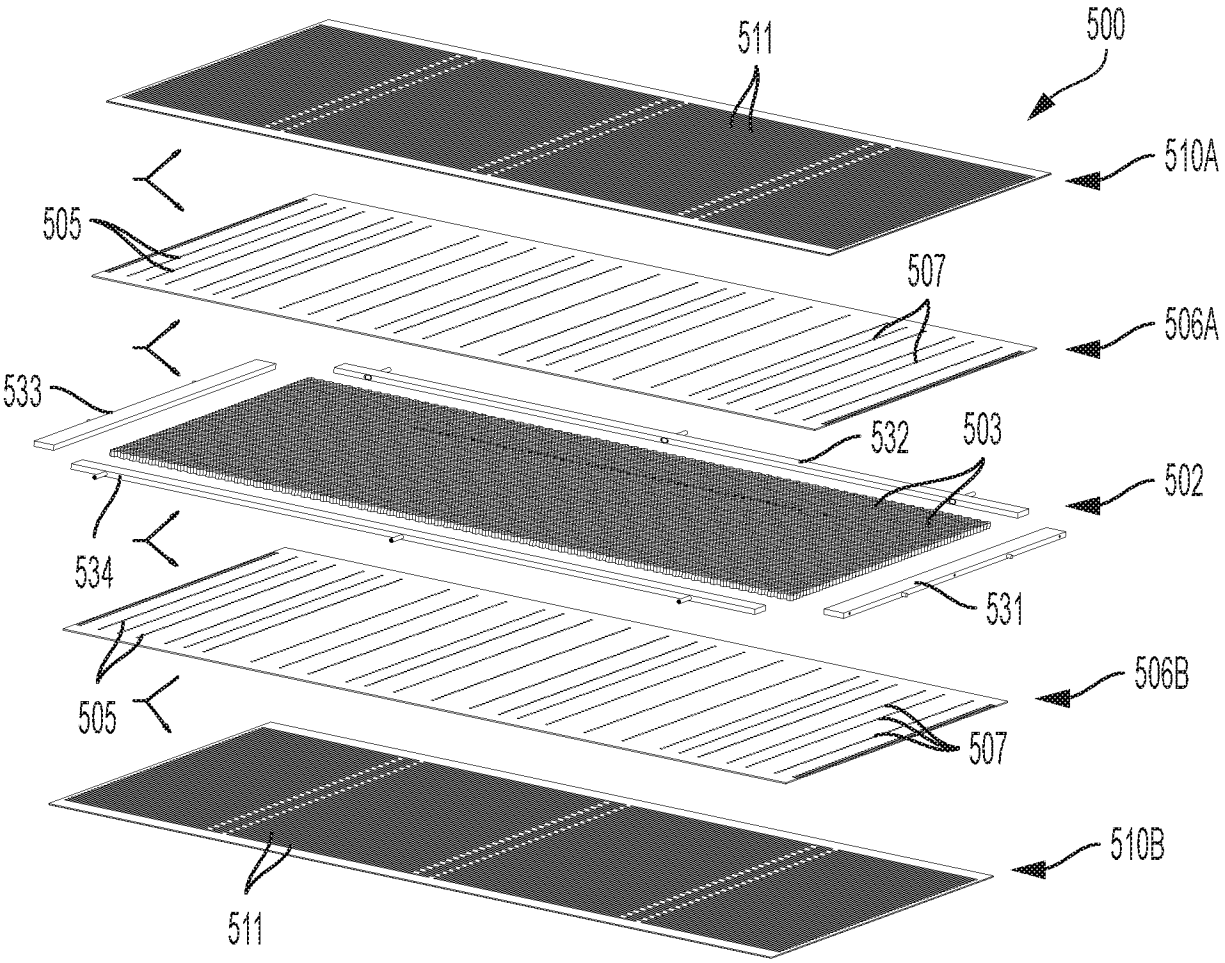
FIG. 5 illustrates an exemplary embodiment of a honeycomb platen in accordance with the present disclosure.

FIG. 5 illustrates an exploded view of another exemplary honeycomb core platen 500 in accordance with the present disclosure. The honeycomb platen 500 is rectangular in shape including a rectangular honeycomb core 502. The honeycomb core 502 is an array of hollow columnar cells 503 each having a hexagonal shape. The honeycomb core 502 is composed of aluminum.

A plurality of core frame members 531, 532, 533, and 534 are connected to the honeycomb core 502 around the edge perimeter. In other words, the honeycomb core 502 having a rectangular shape, includes a frame member along each edge. The frame members 531-534 may be connected to the honeycomb core by a plurality of fasteners or by an adhesive. In some embodiments, the frame members 531-534 provide additional structural stiffness to the honeycomb platen 500. In other words, the frame members 531-534 aid in the prevention of bending and flexing of the platen 500. In other embodiments, the frame members 531-534 may include structures, such as tabs 535 for connecting the platen 502 to a printing system, such as printing system 10 of FIG. 1. In other embodiments, and described in greater detail below, the plurality of frame members 531-534 are configured to receive and connect to modular mounting adaptors.

A first inner layer 506A and second inner layer 506B are laminated via an adhesive to a first and second side of the honeycomb core 502, respectively. That is, the honeycomb core 502 in combination with the plurality of frame members 531-534, define a core surface area on each of the first and second side of the honeycomb core 502. In some embodiments, the first inner layer 506A and second inner layer 506B are laminated to cover the entire core surface area. In other embodiments, the first inner layer 506A and second inner layer 506B are shaped such that they only cover a surface of the honeycomb core and do not overlap with the additional surface area provided by the plurality of frame members.

The first inner layer 506A and second inner layer 506B include a plurality of holes 507 through the entire thickness of the layer. The plurality of holes 507 according to the exemplary embodiment of FIG. 5 are provided in a plurality of rows 505 perpendicular to the long edge of the rectangular honeycomb core 502. In embodiments, wherein a plurality of frame members 531-534 are attached to the honeycomb core, the inner layers 506A and 506B are configured such that no holes 507 are present over the surface area provided by the frame members 531-534.

A first face layer 510A and second face layer 510B are laminated on to the exposed surface of each of the inner layers 506A and 506B, respectively. In other words, the inner layer 506A is between the first face layer 510A and honeycomb core 502 and the second inner layer 506B is between the second face layer 510B and honeycomb core 502.

The face layer 510A and second face layer 510B include a plurality of slots 511 through the entire thickness of the layer. The plurality of elongated slots 511, according to the exemplary embodiment of FIG. 5, have a long axis parallel to a long edge of a rectangular shape of the and a short axis perpendicular to the long edge of the rectangular shape. The long axis may extend along the surface to correspond to at least one hole 507 of an underlying inner layer (506A, 506B). In some embodiments, the long axis extends to cover 2, 3, 4, 5, 6, 7, 8, 9 and 10, holes 507 of the inner layer. The short axis of the slot may have a width that corresponds to the width of a hole 507 of an inner surface. That is, the short axis of the slot 511 is about the length of a diameter of a single hole 507 to about 2 times the diameter of a single hole. In embodiments, wherein a plurality of frame members 531-534 are attached to the honeycomb core, the face layers 510A and 510B are configured such that no slots 511 are present over the surface area provided by the frame members.

It is to be understood that the columnar cells 503, holes 507, and slots 511, are in substantial alignment such that negative pressure applied from vacuum source is able to draw air from one face surface 510A to the other face surface 510B and vice versa. This allows for a media sheet 507 to be forced into flat contact with a perforated belt (such as belt 308) of an associated transport system.

Figure 6:
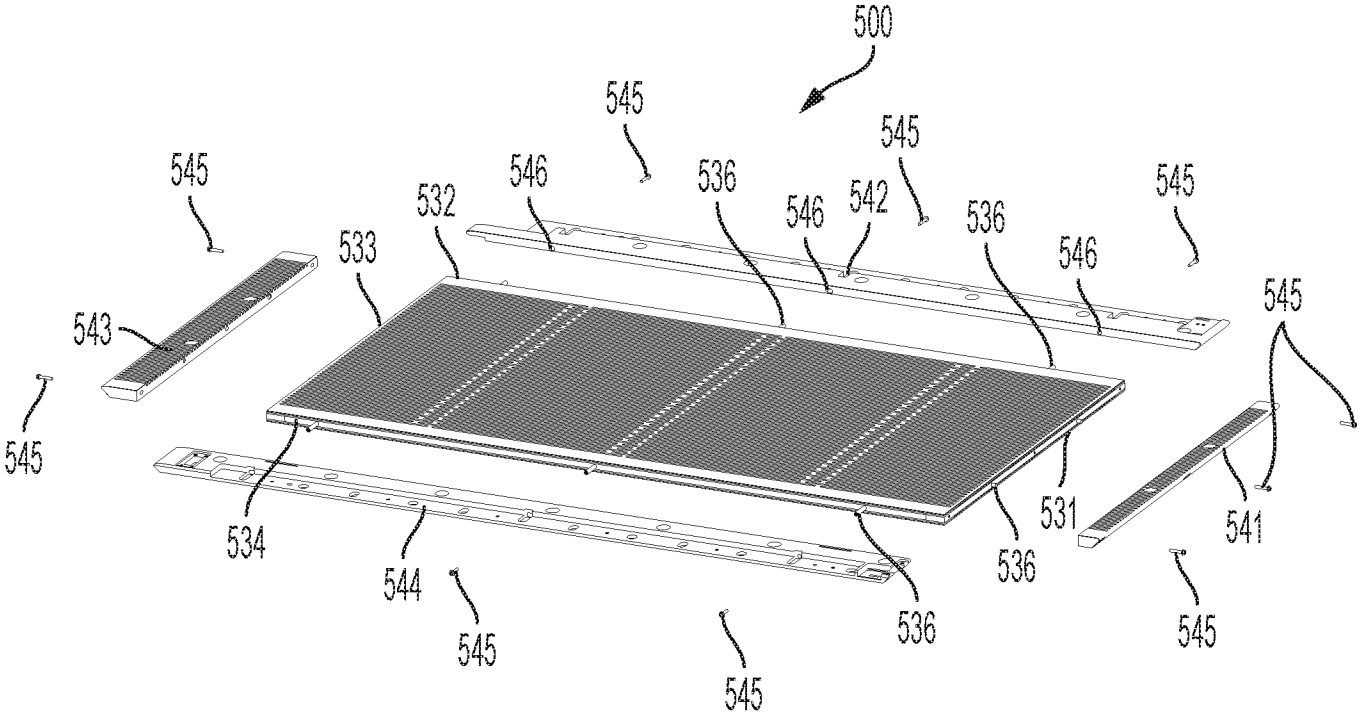
FIG. 6 illustrates the exemplary embodiment of FIG. 5 including exemplary modular mounts configured to attach to a perimeter frame.

In some embodiments and with reference to FIGS. 5 and 6, a plurality of frame members 531-534 are configured to receive and removably connect to a plurality of modular mounts 541-544 about the perimeter of the platen 500. The connection may be provided by fasteners 545, e.g., screws. The frame members 513-534 provide a mounting surface capable of receiving a corresponding mounting surface of a modular mount. The shape and features of the modular mount 541-544 may depend on a desired use or particular need of the machine. That is, the modular mounts 541-544 may be configured to receive sensors, printing components, media alignment components, transport belt and the like. Because the modular mounts 541-544 are removably attached, particular modular mounts designed for mounting specific accessories or particular mounts designed for interacting with certain components of the transport system or associated printing machine may be swapped in or out as desired.

In some embodiments, the modular members include a plurality of bores 546 configured to each receive a tab 536 of a frame member. The tab 536 may include a set of internal threads configured to engage a set of external threads of an associated fastener 545 for securing a modular member to a frame member.

It is to be understood that while the frame members 531-534 are disclosed as being adhered to the honeycomb core 502 and laminated between the inner layers and face layers, that frame members 531-534 may be adhered to a honeycomb core platen including at least one laminated layer. In these embodiments, the frame members are configured to such that the outermost surfaces of the honeycomb platen are continuous and even with the addition of the frame members.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art, which are also intended to be encompassed by the following claims.

To aid the Patent Office and any readers of this application and any resulting patent in interpreting the claims appended hereto, applicants do not intend any of the appended claims or claim elements to invoke 35 U.S.C. 112(f) unless the words "means for" or "step for" are explicitly used in the particular claim.

What is claimed is:

1. A platen for use in a media transport system operatively associated with a printing system, the platen comprising:

a honeycomb core comprising an array of hollow columnar cells formed between vertical walls, at least one face layer as an outermost layer of the platen, the at least one face layer operatively connected to the honeycomb core and including a plurality of slots in vacuum communication with the array of hollow columnar cells, and at least one inner layer disposed between the honeycomb core and at least one face layer, the inner layer including a plurality of holes configured to communicate vacuum between the honeycomb core and at least one face layer, wherein at least one surface of the platen is configured to operatively connect to a vacuum source and communicate a negative pressure through the array of hollow columnar cells and plurality of slots.

2. The platen according to claim 1, further comprising a low friction coating disposed on an outer surface of the at least one face layer, wherein the low friction coating minimizes the friction between the face layer and an associated belt.

3. The platen according to claim 1, further comprising a frame attached to a perimeter edge of the honeycomb core.

4. The platen according to claim 3, wherein the face layer is configured to cover a combined surface area of the honeycomb core and attached frame.

5. The platen according to claim 3, wherein the frame is composed of a plurality of frame members.

6. The platen according to claim 3, wherein the frame includes at least mounting surface configured to receive and removably connect to a mounting member.

7. The platen according to claim 6, wherein the mounting member is attached to frame mounting surface by at least one fastener.

8. The platen according to claim 1, further comprising a frame attached to a perimeter edge of the honeycomb core, wherein the face layer and inner layer stack cover a combined surface area of the honeycomb core and attached frame.

9. The platen according to claim 1, further comprising a frame attached to a perimeter edge of the honeycomb core, wherein the frame is positioned between the first inner layer and second inner layer and adjacent to the perimeter edge of honeycomb core.

10. A platen for use in a media transport system operatively associated with a printing system, the platen comprising:

a honeycomb core comprising an array of hollow columnar cells formed between vertical walls, and at least one face layer as an outermost layer of the platen, the at least one face layer operatively connected to the honeycomb core and including a plurality of slots in vacuum communication with the array of hollow columnar cells, wherein at least one surface of the platen is configured to operatively connect to a vacuum source and communicate a negative pressure through the array of hollow columnar cells and plurality of slots, wherein the at least one face layer includes a first face layer and second face layer, and wherein the first face layer and second face layers are the outermost layers of the platen.

11. The platen according to claim 10, wherein the first face layer includes a plurality of first slots having a first slot size and first slot shape and the second face layer includes a plurality of second slots having a second slot size and second slot shape.

12. The platen according to claim 11, wherein the first slots are identical to the second slots.

13. The platen according to claim 10, further comprising a first inner layer disposed between the honeycomb core and first face layer and a second inner layer disposed between the honeycomb core and second face layer.

14. The platen according to claim 13, wherein the first inner layer includes a plurality of first holes having a first hole size and first hole shape and the second inner layer includes a plurality of second holes having a second hole size and second hole shape.

15. A media transport system operatively associated with a printing system comprising:

a perforated belt including a plurality of belt apertures mounted on a plurality of rollers;

a platen having a surface disposed below the perforated belt including a honeycomb core having a thickness and composed of an array of hollow columnar cells formed between vertical walls; and a vacuum plenum being operatively connected to a vacuum source and configured to apply a negative pressure to a media through the array of hollow columnar cells and plurality of belt apertures for securing the media to the perforated belt wherein the platen further comprises at least one face layer as an outermost layer of the platen and is configured to contact an inner facing surface of the belt, the face layer including a plurality of slots in vacuum communication with the array of hollow columnar cells and belt apertures, and wherein the platen further comprises at least one inner layer disposed between the honeycomb core and at least one face layer, the inner layer including a plurality of holes configured to communicate vacuum between the honeycomb core and at least one face layer.

16. The media transport system of claim 15, wherein the vacuum platen is reversable.

17. The media transport system of claim 15, further comprising a frame attached to a perimeter edge of the honeycomb core.

18. The platen according to claim 17, wherein the face layer is configured to cover a combined surface area of the honeycomb core and attached frame.

19. The platen according to claim 17, wherein the frame is composed of a plurality of frame members.

20. The platen according to claim 17, wherein the frame includes at least mounting surface configured to receive and removably connect to a mounting member.

21. The platen according to claim 20, wherein the mounting member is attached to frame mounting surface by at least one fastener.

22. A media transport system operatively associated with a printing system comprising:

a perforated belt including a plurality of belt apertures mounted on a plurality of rollers;

a platen having a surface disposed below the perforated belt including a honeycomb core having a thickness and composed of an array of hollow columnar cells formed between vertical walls; and a vacuum plenum being operatively connected to a vacuum source and configured to apply a negative pressure to a media through the array of hollow columnar cells and plurality of belt apertures for securing the media to the perforated belt, wherein the platen further comprises a first face layer and second face layer, wherein the first face layer and second face layers are the outermost layers of the platen and one of the first face layer and second face layer is configured for slidable contact with an inner surface of the belt.

23. The media transport system of claim 22, wherein the first face layer includes a plurality of first slots having a first slot size and first slot shape and the second face layer includes a plurality of second slots having a second slot size and second slot shape, wherein vacuum is communicated from the vacuum plenum to the belt through the plurality of first slots of the first face layer, the columnar cells of the honeycomb core, and the plurality of second slots of the second face layer.

24. A media transport system operatively associated with a printing system comprising:

a perforated belt including a plurality of belt apertures mounted on a plurality of rollers;

a platen having a surface disposed below the perforated belt including a honeycomb core having a thickness and composed of an array of hollow columnar cells formed between vertical walls; and a vacuum plenum being operatively connected to a vacuum source and configured to apply a negative pressure to a media through the array of hollow columnar cells and plurality of belt apertures for securing the media to the perforated belt, wherein the platen further comprises a first inner layer disposed between the honeycomb core and first face layer and a second inner layer disposed between the honeycomb core and second face layer.

25. The media transport system of claim 24, wherein the first inner layer includes a plurality of first holes having a first hole size and first hole shape and the second inner layer includes a plurality of second holes having a second hole size and second hole shape, and the first face layer includes a plurality of first slots having a first slot size and first slot shape and the second face layer includes a plurality of second slots having a second slot size and second slot shape, wherein vacuum is communicated from the vacuum plenum through the belt via the plurality of first slots of the first face layer, the plurality of first holes of the first inner layer, the columnar cells of the honeycomb core, the plurality of second holes of the second inner layer and the plurality of second slots of the second face layer.

26. A process for making a platen for use in a media transport system associated with a printing system comprising:

providing a honeycomb core composed of an array of hollow columnar cells formed between vertical walls;

laminating via an adhesive at least one layer to a first surface of the honeycomb core; and generating a substantially flat top surface by pressing the at least one laminated face layer and honeycomb core in a press machine, wherein the lamination step includes laminating a layer stack, the layer stack including an inner layer comprising a plurality of holes and a face layer comprising a plurality of slots to the honeycomb core, wherein the inner layer is disposed between the honeycomb core and face layer and wherein the plurality of holes, plurality of slots, and array of hollow columnar cells are in aligned to communicate negative pressure through a thickness of the platen.

27. The process for making a platen according to claim 26, wherein prior to lamination of the at least one layer, at least one frame member is adhered to a perimeter edge of the honeycomb core, wherein the at least one layer is configured to cover a combine surface area of the honeycomb core and the adhered at least one frame member.

28. A process for making a platen for use in a media transport system associated with a printing system comprising:

providing a honeycomb core composed of an array of hollow columnar cells formed between vertical walls;

laminating via an adhesive at least one layer to a first surface of the honeycomb core; and, generating a substantially flat top surface by pressing the at least one laminated face layer and honeycomb core in a press machine, wherein the lamination includes:

laminating a first layer stack including a first inner layer comprising a first plurality of holes and a first face layer comprising a first plurality of slots to one surface of the honeycomb core; and laminating a second layer stack including a second inner layer comprising a second plurality of holes and a second face layer comprising a second plurality of slots to an opposite surface of the honeycomb core, wherein the first inner layer is disposed between the honeycomb core and first face layer;

wherein the second inner layer is disposed between the honeycomb core and second face layer; and wherein the first and second plurality of holes, first and second plurality of slots, and array of hollow columnar cells are aligned to communicate negative pressure through a thickness of the platen.

* * * * *